US010322335B1

(12) United States Patent
Krieman

(10) Patent No.: US 10,322,335 B1
(45) Date of Patent: Jun. 18, 2019

(54) FINGER FLICK BALL GAME

(71) Applicant: KRIECO INDUSTRIES LLC, Prairie View, IL (US)

(72) Inventor: Scott Krieman, Buffalo Grove, IL (US)

( * ) Notice: Subject to any disclaimer, the term of this patent is extended or adjusted under 35 U.S.C. 154(b) by 0 days.

(21) Appl. No.: 15/907,900

(22) Filed: Feb. 28, 2018

(51) Int. Cl.

| | |
|---|---|
| ***A63B 63/00*** | (2006.01) |
| ***A63F 7/36*** | (2006.01) |
| ***A63F 9/06*** | (2006.01) |
| *A63F 7/34* | (2006.01) |
| *A63F 7/40* | (2006.01) |

(52) U.S. Cl.
CPC ..... *A63F 7/36* (2013.01); *A63B 63/00* (2013.01); *A63F 9/0602* (2013.01); *A63B 2063/001* (2013.01); *A63B 2209/00* (2013.01); *A63F 7/40* (2013.01); *A63F 2007/341* (2013.01); *A63F 2007/345* (2013.01); *A63F 2250/22* (2013.01)

(58) Field of Classification Search
CPC ..... A63B 63/00; A63B 2063/001; A63B 2209/00; A63F 7/00; A63F 7/02; A63F 7/34; A63F 7/36; A63F 2007/345; A63F 9/0602; A63F 7/40; A63F 2007/341; A63F 2250/22
See application file for complete search history.

(56) References Cited

U.S. PATENT DOCUMENTS

| | | | | | |
|---|---|---|---|---|---|
| 2,433,224 | A * | 12/1947 | Koci | A63F 7/0612 | 124/1 |
| 2,535,225 | A * | 12/1950 | Oczkowski | A63F 7/0612 | 124/79 |
| 3,537,707 | A * | 11/1970 | Goldberg | A63F 7/02 | 124/4 |
| 3,561,762 | A * | 2/1971 | Russell | A63F 7/0612 | 206/45.3 |
| 3,617,059 | A * | 11/1971 | Grant | A63F 9/02 | 273/340 |
| 4,186,926 | A * | 2/1980 | Kulesza | A63F 7/00 | 124/79 |
| 5,480,147 | A * | 1/1996 | Ethier | A63B 24/0021 | 273/317.3 |
| 5,738,355 | A * | 4/1998 | Gibson | A63F 7/045 | 273/457 |
| 2009/0036201 | A1* | 2/2009 | Okuda | A63B 24/0021 | 463/23 |
| 2011/0256945 | A1* | 10/2011 | Hsiang | A63B 63/00 | 473/194 |
| 2014/0274490 | A1* | 9/2014 | Niu | A63B 71/04 | 473/478 |

* cited by examiner

*Primary Examiner* — Raleigh W Chiu
(74) *Attorney, Agent, or Firm* — William Gray Mitchell

(57) ABSTRACT

The invention is a game for amusement including a cabinet, a ball and one or more targets wherein the ball can be flicked by a player's finger in an attempt to contact, engage or activate the one or more targets.

9 Claims, 4 Drawing Sheets

FINGER FLICK BALL GAME

CROSS REFERENCE TO RELATED APPLICATIONS

Not applicable.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention is a game wherein a ping pong ball is flipped with the player's finger to contact one or more targets.

Background of the Invention

Games for amusement involving the flicking of a ball up onto a board, through obstacles or at targets have been long known. In particular, pinball games involve the flicking of a ball using hand-operated flippers, wherein the player attempts to aim the balls at multiple targets located at different points on an angled board. After each such attempt, gravity returns the ball to the bottom of the board and the player makes another attempt, until such time as the ball passes the flippers through one of several openings that remove the ball and end the player's turn.

Similarly, the game of pachinko, originating in Japan, operates as both a recreational and gambling device. In this type of game, a smaller ball is released with a spring-loaded hammer upward along a track, only to fall once it loses momentum. Upon falling the one or more balls travel through a maze of pins, bumpers and openings which can be assigned with point values or prizes.

Pinball and similar games tend to be used by taverns, arcades and restaurants as both attractive amusements to draw customers, as well as revenue-generating machines in themselves. A game of pinball or a similar machine serves to provide customers with an entertainment that will keep them in an establishment longer and thereby increase the amount of money spent in such establishment.

However, the intricacy and fragility of pinball, pachinko and similar mechanized games makes the machines relatively expensive to buy and maintain. Further, as videogames have permeated the markets and displaced older mechanical games, the number of service professionals for maintaining older, mechanical games has shrunk. As a result, the prevalence of functional mechanical amusement games in public establishments has waned considerably over the last two decades. When such games still exist in public spaces, they are often partially or completely nonfunctional.

What is needed is an affordable, simple type of mechanical amusement game for bars and restaurants that requires little or no maintenance once it has been purchased. Such a game would comprise few moving parts and little or no electrical wiring, thus pleasing patrons over a period of years without requiring service calls or the payment maintenance expenses by the owners. Such a game type is described herein below.

BRIEF SUMMARY OF THE INVENTION

In a preferred embodiment, a game comprising a cabinet with a plexiglass front, a back panel, a cup secured to the back panel and an angled front panel with a ball catch embodied as a hole of a circumference allowing a portion of a ball to protrude through without exiting the cabinet.

In another preferred embodiment, the game as described herein, further comprising a cord which, when pulled, tips the cup sideways and allows the ball contained therein to fall downward within the cabinet and into the ball catch.

In another preferred embodiment, the game as described herein, wherein the cord pulls a spring-loaded lever attached to the rear of the cup, which lever tips the cup, and upon release of the cord, the spring returns each of the lever and the cup to its original position.

In another preferred embodiment, the game as described herein, wherein the cord protrudes through the angled front panel, extends upward behind the back panel and attaches to a lever behind the back panel and the lever is attached to the cup with a bolt running through the back panel such that a pull on the cord depresses the lever, rotates the bolt, and tips the cup.

In another preferred embodiment, the game as described herein, wherein the rear panel is angled toward the user, further comprising left and right catch panels and slides, combining to funnel the descending ball towards the ball catch.

In another preferred embodiment, the game as described herein, wherein the cup is overlaid by an attached, decorative plate.

In another preferred embodiment, the game as described herein, wherein no angled front panel is provided, and the ball catch is instead located in a bottom panel.

In another preferred embodiment, the game as described herein, further comprising wherein a back plate is secured to the rear of the back panel between the lever and the back panel.

In another preferred embodiment, the game as described herein, wherein the ball is a ping pong ball.

In another preferred embodiment, the game as described herein, wherein the player flicks the ball resting in the ball catch upward until the ball lands in the cup.

DETAILED DESCRIPTION OF THE INVENTION

Figure 1:
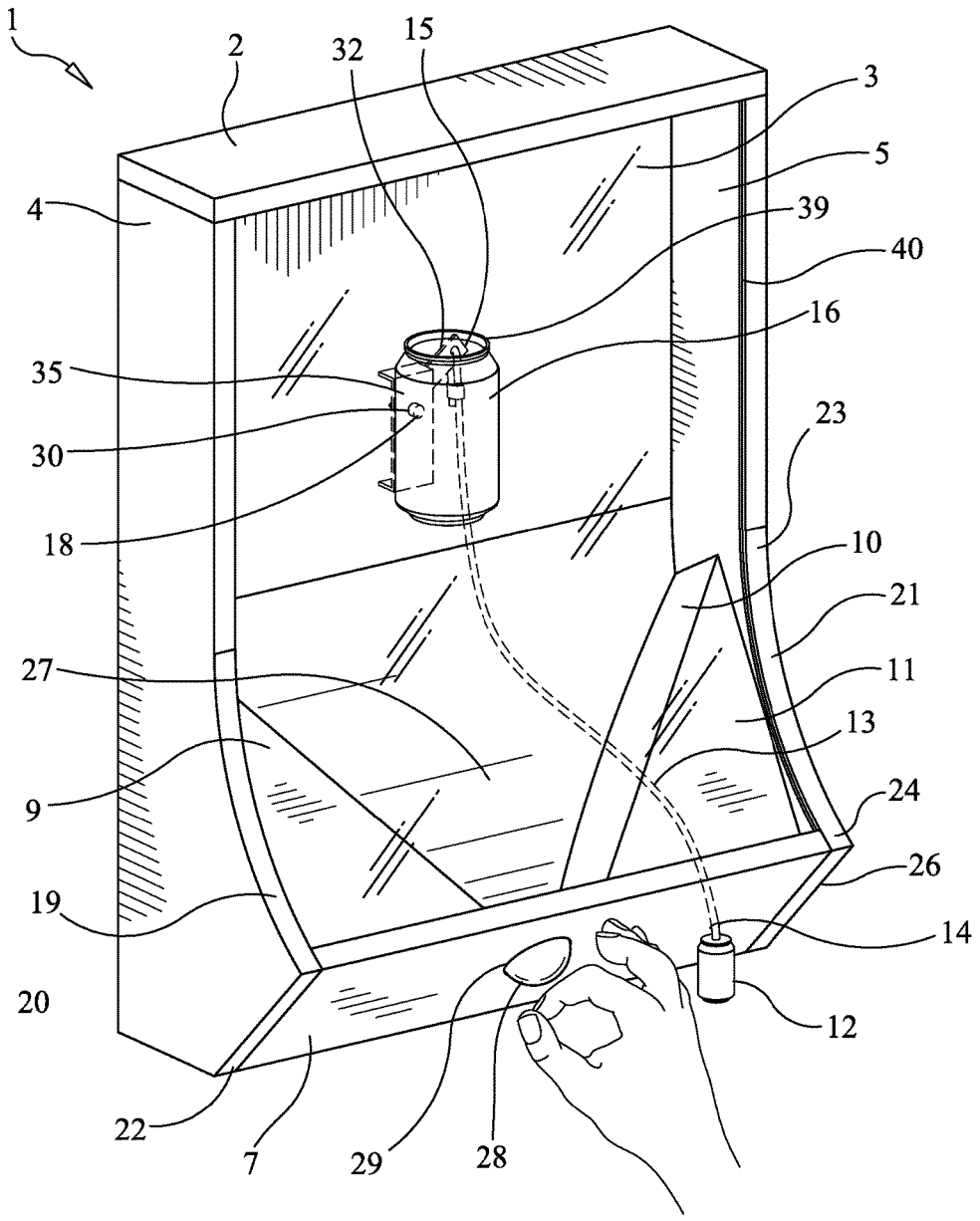
FIG. 1 is a line drawing evidencing a primary embodiment of the ball game invention.

The invention constitutes a game for amusement comprising a cabinet, back or rear board, and a cup feature. A ball, preferably a ping pong ball, or similar item is to be flicked upward within the cabinet utilizing a player's finger or a mechanical replacement for a finger, in an attempt to land the ball in a cup or similar target(s) which are preferably mounted on to the back panel or an interior surface of the cabinet. The cabinet serves to contain the ball within itself, ensuring that the ball comes to rest either in the cup or in a designated catch position either built inside of or integrated within the cabinet, from which the player may launch the ball again.

Any number of target types may be employed within the game. These would include, without limitation, switches, gates, tubes, bells, spinners, ramps, kickers, slingshots, rollers, and pins.

The game may employ one or more company or product names, logos, or other artwork allowing the game to serve as an advertising or decorative item in addition to its primary amusement function.

In one embodiment, the cup feature is a funnel or similar configuration with a pass-through functionality. In an alternate, preferred embodiment, the cup has a closed bottom and an accompanying mechanism is provided allowing the player to empty the cup of the ball by either tilting the cup or opening the cup bottom. In such an embodiment, the cup may be an actual beer can or replicated beer can with an open top. Such a mechanism could comprise a handle or wheel on the front of such cup feature allowing the user to twist and/or dump the cup directly. Alternatively, a remotely located switch, lever or pull cord could be located on the front, side or bottom of the cabinet, allowing the player to twist and/or dump the cup remotely. Such a remote mechanism would be attached to the cup via a cord, cable, rod, or similar means of attachment. Multiple cups or other types of targets could similarly be mounted in different locations within the cabinet.

In a primary embodiment, the cabinet is rectangular with a flat bottom panel, such that it may be either mounted on a call or situated on top of a level surface. The cup is box-shaped with the upper side open and centered in an upper portion of the back panel, to which the cup is attached by a twistable cup bolt secured with a cup bolt nut. Such bolt proceeds through corresponding bolt holes in a moveable lever, a back plate mounted on the rear surface of the back panel, a hole in the back panel and finally the cup itself. In this embodiment, the cup bolt is immovably attached to the lever and the cup, but allowed freedom to twist within the bolt holes in the back panel and back plate. Thus, the movement of the lever serves to twist the bolt, and then twist the cup on the other side of the back panel, thereby dumping the ball and allowing it to fall through the cabinet and return to the ball catch for another launch.

This primary embodiment, further comprises a cabinet with triangular catch panels in each lower corner, each such catch panel with a catch slide. The two catch slides together form a funnel to direct the ball as it drops towards a center portion of a front panel. This front panel is angled upward towards the front of the game and, together with the funnel shape of the catch slides, provides a bottom area into which the ball will finally come to rest. An appropriately-sized ball catch hole is drilled through such front panel, allowing a portion of the ball to protrude outward towards the user, thus allowing the user to flick the ball from outside the cabinet to launch it again towards the cup. In one embodiment, the ball catch hole has a semicircular finger-sized protrusion on one side, allowing for insertion of a user's finger.

Optionally, the cabinet may include a plexiglass front component for keeping the ball within the cabinet while allowing the user to see the action. In a preferred embodiment, the plexiglass is inserted into a groove running along the inside of the cabinet sides and tracking the line of the game front.

In an alternate embodiment, the cabinet may forego the use of an angled front panel, instead placing the ball catch hole directly into the center of the lower panel. In this cabinet configuration, the cabinet may be laid down on an angled surface for play.

In another alternate embodiment, one or more targets may employ noise or light characteristics, whether mechanical or electric. In one such embodiment, one or more mechanical bells may be used as or within targets. In another, a target may comprise a switch signaling, by motion-activation or otherwise, the illumination of a light or emission of noise from an electric speaker.

Materials to be used for the cabinet would be either solid wood, particle board or a similar non-wood composition, or plywood for the back panel. Such plywood dimensions may range from 1/16" to 1/2", with a preferred thickness of 1/8". Any appropriate commercial-grade plastic would be an acceptable substitute for any wood material.

Components of the cabinet may be combined using any known woodworking technique, including the use of tongue-in-groove placement, slotting, and the use of pegs, screws or other known hardware for connection. Adhesives are also a preferred connective mechanism, either alone or in combination with the aforementioned techniques. If plastic is used, a single, integrated cabinet could be made using injection molding or a similar technique. Thicknesses of the various panels may range from 1/4" to 2", with a preferred thickness from 1/2" to 1".

Materials to be used for non-cabinet components such as the cup, lever, back plate, and associated hardware would be either commercially known metals or comparable plastic.

As described, the game can either be hung on a wall, set on a tabletop, countertop or bartop for play. If wall-hung, a preferred method of hanging is by using a French cleat. The game may also comprise a plate or other decorative cover overlaying the cup, for example to resemble a beer can. The game may also comprise other ornamentation, such as logos of the products being sold in a given establishment, in order to serve an advertising function.

DETAILED DESCRIPTION OF THE FIGURES

FIG. 1 shows a first embodiment of game 1, surrounded by a cabinet comprised of top panel 2 with a left end connected to left panel 4 and a right end connected to right panel 5, together comprising the cabinet sides. Left panel 4 and right panel 2 are connected at their opposite ends to the corresponding ends of bottom panel 6 (not pictured). Back panel 3 is attached across the length of each of top panel 1, left panel 4, right panel 5 and bottom panel 6. The left panel forward edge 19 and right panel forward edge 21 each flare outward away from the back panel 6 as they approach the bottom panel before each reaches a corner 20,23 and retreats at an angle back toward the bottom panel 6, forming left panel cutback 22 and right panel cutback 26, respectively.

Front panel 7 is embodied as a rectangle comprising ball catch 29 in its center and running across bottom panel 6 and between left panel cutback 22 and right panel cutback 26. Back panel 3 comprises a slope 27 angling towards the front panel 7 and approximately corresponding to the outward flare 20, 24 of the side panels, for the purpose of catching and directing ball 28 towards ball catch 29, embodied as a circular hole located in the center of the front panel.

A triangular left catch panel 9 is fitted into the left corner formed by left panel 4 and front panel 7, with left catch slide 8 (not pictured) running between the catch panel side opposite the corner and the corresponding portion of the back panel 3. In the opposite right corner, a corresponding right catch slide 10 and right catch panel 11 are located. Together with the back panel, the two catch slides serve to catch the dropping ball 28 and direct it towards the ball catch 29.

Finally, a plexiglass groove 40 is shown as being cut into the left and right panels 4,5, tracking the line of the front of each such panel. As the cabinet is assembled, a clear plexiglass cover 41 (not annotated) will be slid into such groove, with such plexiglass cover trapping the ball inside the cabinet while allowing the user to see it.

In FIG. 1, cup 16 is a cylindrical compartment embodied as a beer can with an open mouth 39 facing upward in the default position. Cup 16 is located approximately in the center of the back panel 3 and is attached thereto utilizing a cup bolt 17 (not pictured) extending through cup bolt hole 30 and secured with cup bolt nut 18, allowing the cup 16 to swivel in response to the action of cord 13. Cord pull 12 is located on the end of cord 13, pictured as emanating from cord pull hole 14 in front panel 7. The cord then extends behind the back panel 3 to and through cord entry hole (not pictured) for ultimate attachment to lever 32 behind the rear panel, such that a user pulling such cord will cause the lever to depress, turning the bolt and forcing the cup to swivel. Lever 32 is mounted on back plate 35, which is arranged between the lever and rear panel.

In the event that ball 29 is located within the cup, pulling the cord will depress the lever and twist the bolt through the back plate, rear panel and the ball will be released from the cup mouth upon such swivel action, after which it will fall downward and eventually become lodged in ball catch 29.

Figure 3:
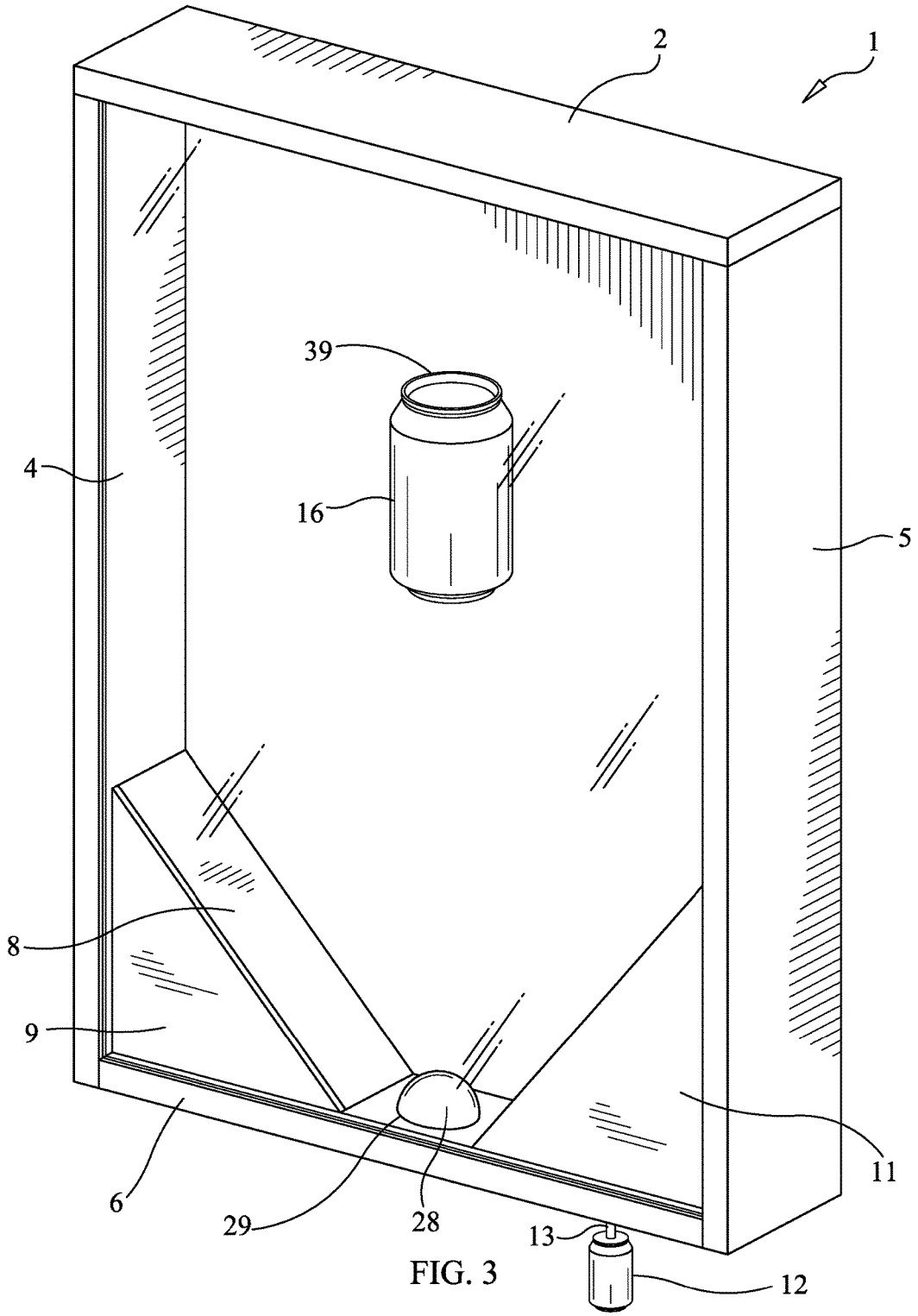
FIG. 3 is a line drawing evidencing an alternate embodiment of the game of FIG. 1 in which no front panel is used.

FIG. 3 shows a rear view of the lever 32 mechanism game of FIG. 1, evidencing the attachment of the cup to back panel 3 utilizing cup bolt 17, the head of which is visible, with the cup bolt extending sequentially through the lever bolt hole 34, the back plate bolt hole 39, the back panel bolt hole 40 and the cup bolt hole 30. The cup bolt is secured using the cup bolt nut 18, not pictured, against the interior surface of the cup. The cord 13 is pictured attached to cord lever hole 15 in the lever 32, with the spring 35 extending from the back plate spring hole 37 to the lever spring hole 33. The back plate is mounted on the rear surface of the back panel using back plate screws 38.

Figure 2:
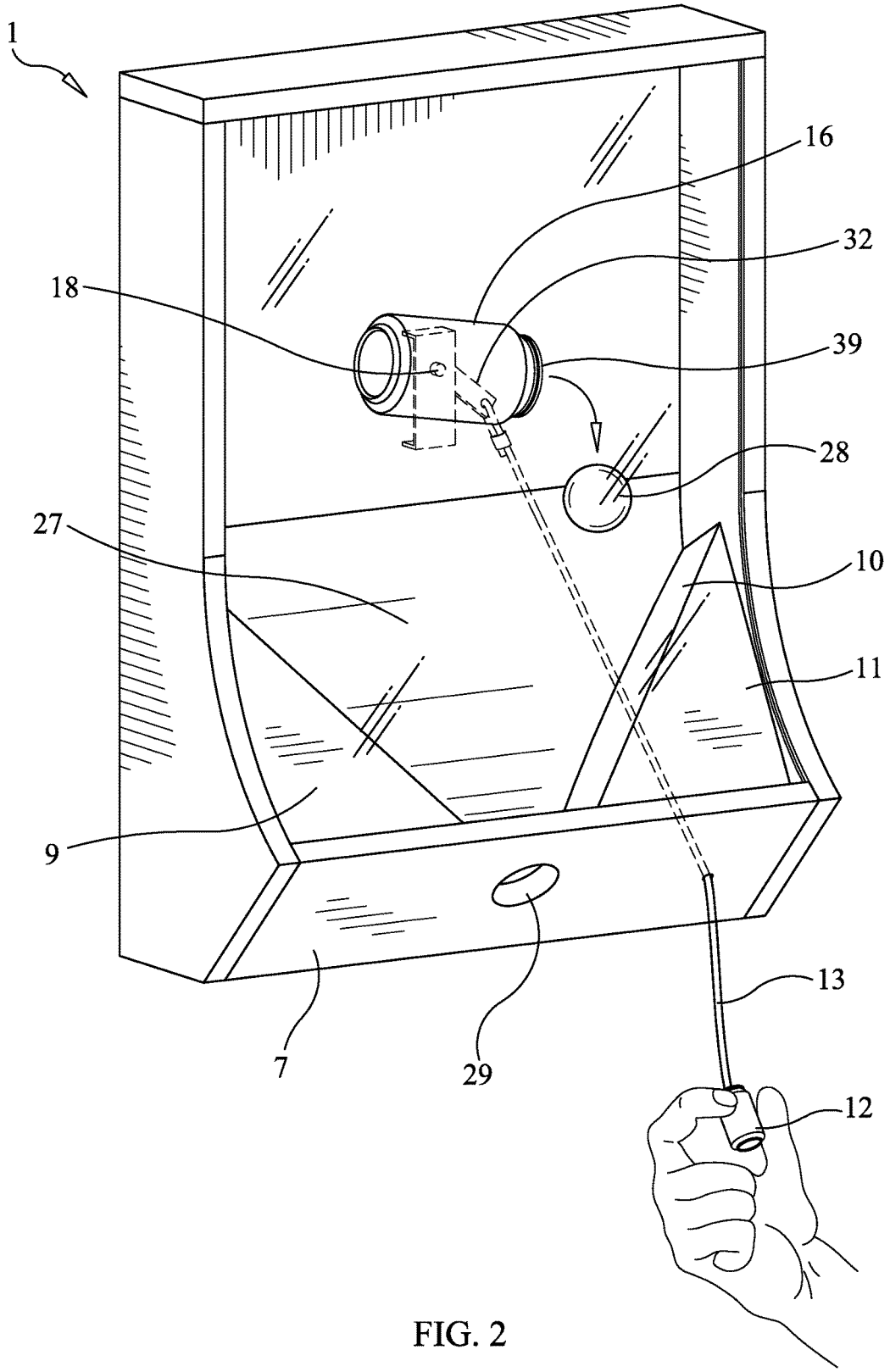
FIG. 2 is a line drawing evidencing the game of FIG. 1 with a pull cord engaged.

FIG. 2 is a second illustration of the game of FIG. 1, wherein the user has pulled cord pull 12, thus pulling cord 13 down, depressing lever 32 and tilting cup 16 so that the ball 28 is released from the cup mouth 19. As pictured, the ball will fall onto right catch slide 10 and be guided downward towards the ball catch 29 in front panel 7.

FIG. 3 shows a second embodiment of game 1, in which no front panel is used and the ball catch 29 is instead centered within the bottom panel 6. The absence of a front panel also obviates the need for a back panel slope, as the ball 28 releases in a directly downward path from the cup 16 upon swiveling engaged by cord 13. Aside from these distinctions, the embodiment of FIG. 3 and parts contained therein otherwise correspond to those of FIG. 1.

Figure 4:
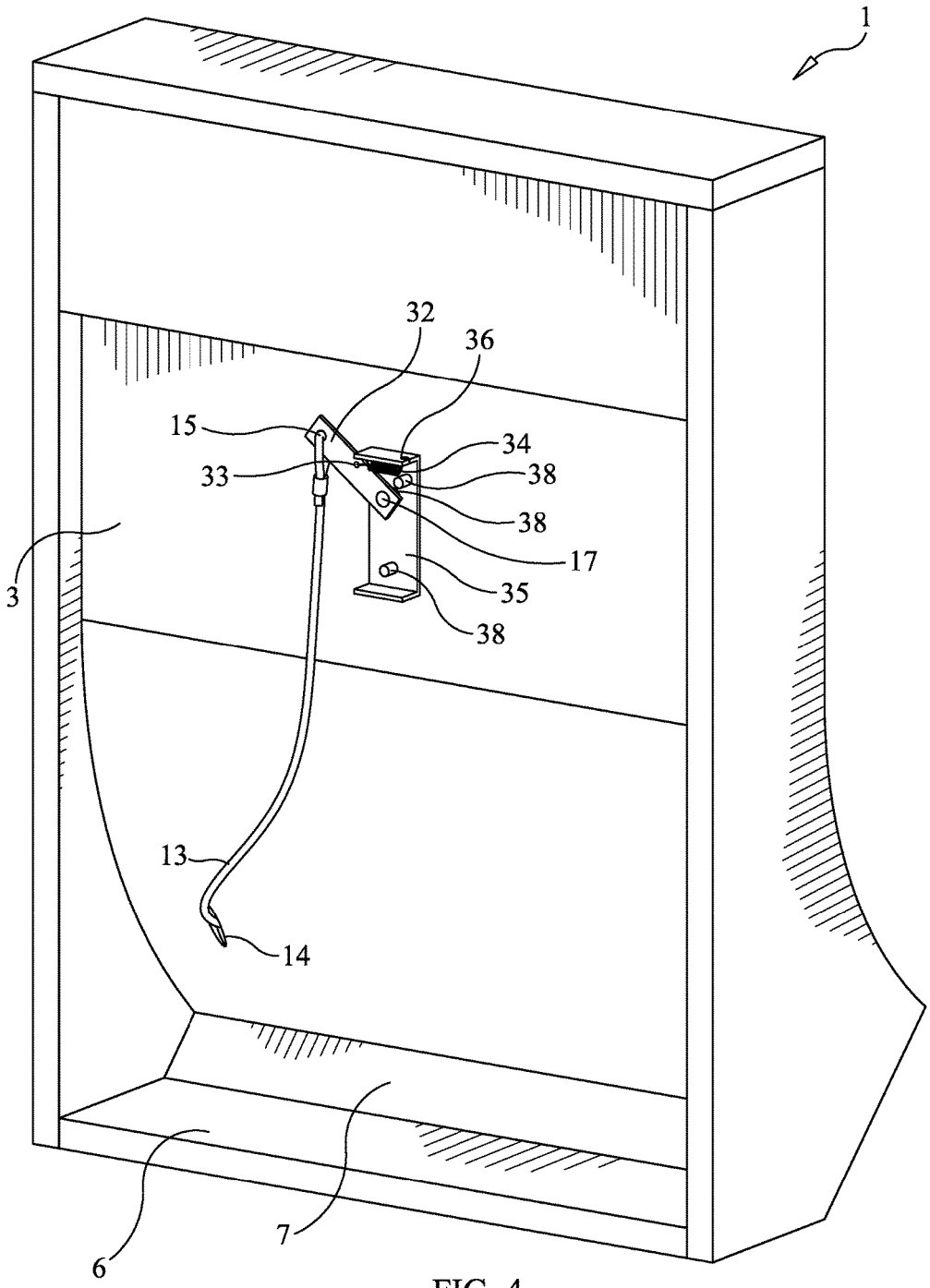
FIG. 4 is a line drawing evidencing a rear view of the game of FIG. 1.

FIG. 4 shows a rear view of the game of FIG. 1, showing the rear of back panel 3 with cord 13 extending through cord pull hole 14 and then to cord lever hole 15. Lever 32 is attached to back plate 35 with cup bolt 17, while back plate is mounted on the back panel with back plate screws 38. One end of spring 34 is attached to back plate spring hole 36 and the other spring end is attached to lever spring hole 33, such that the spring will extend when the cord is pulled and the lever depressed, then return the lever to its default position when the cord is released.

LIST OF REFERENCE NUMBERS

1 Game
2 Top panel
3 Back panel
4 Left panel
5 Right panel
6 Bottom Panel
7 Front Panel
8 Left catch slide
9 Left catch panel
10 Right catch slide
11 Right catch panel
12 Cord pull
13 Cord
14 Cord pull hole
15 Cord lever hole
16 Cup
17 Cup bolt
18 Cup bolt nut
19 Left panel forward edge
20 Left panel flare
21 Left panel corner
22 Left panel cutback
23 Right panel forward edge
24 Right panel flare
25 Right panel corner
26 Right panel cutback
27 Back panel slope
28 Ball
29 Ball catch
30 Cup bolt hole
31 Decorative plate
32 Lever
33 Lever spring hole
34 Spring
35 Back plate
36 Back plate spring hole
37 Back plate screw holes
38 Back plate bolt hole
39 Cup mouth
40 Plexglass groove
41 Plexiglass cover (clear)

The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A game comprising a cabinet with a plexiglass front, a ping pong ball, a back panel, a cup secured to the back panel and an angled front panel with a ball catch embodied as a hole of a circumference allowing a portion of the ping pong ball to protrude through without exiting the cabinet.

2. The game of claim 1, further comprising a cord which, when pulled, tips the cup sideways and allows the ping pong ball contained therein to fall downward within the cabinet and into the ball catch.

3. The game of claim 2, wherein the cord pulls a spring-loaded lever attached to the rear of the cup, which lever tips the cup, and upon release of the cord, the spring returns each of the lever and the cup to its original position.

4. The game of claim 1, wherein a cord protrudes through the angled front panel, extends upward behind the back panel and attaches to a lever behind the back panel and the lever is attached to the cup with a bolt running through the back panel such that a pull on the cord depresses the lever, rotates the bolt, and tips the cup.

5. The game of claim 1, wherein a rear panel is angled toward the user, further comprising left and right catch panels and slides, combining to funnel a descending ball towards the ball catch.

6. The game of claim 1, wherein the cup is overlaid by an attached, decorative plate.

7. The game of claim 5, wherein a front panel without an angle is provided, and the ball catch is instead located in a bottom panel arranged between the left and right catch panels.

8. The game of claim 1, further comprising wherein a back plate is secured to the rear of the back panel between a lever and the back panel.

9. A method of playing the game of claim 1, wherein the player flicks the ball resting in the ball catch upward until the ping pong ball lands in the cup.

* * * * *